United States Patent [19]

Nakamats

[11] Patent Number: 4,573,686

[45] Date of Patent: Mar. 4, 1986

[54] PUTTING TRAINING DEVICE FOR GOLFERS

[76] Inventor: Yoshiro Nakamats, 1-10-1105, Minami Aoyama 5-chome, Minato-ku, Tokyo, Japan

[21] Appl. No.: 545,622

[22] Filed: Oct. 26, 1983

[30] Foreign Application Priority Data

Oct. 28, 1982 [JP] Japan ..... 57-188182

[51] Int. Cl.[4] ..... A63B 69/36

[52] U.S. Cl. ..... 273/184 A; 273/179 C; 273/176 FB

[58] Field of Search ..... 273/179 R, 179 C, 179 D, 273/179 E, 180, 184 A, 177 R, 176 FB

[56] References Cited

U.S. PATENT DOCUMENTS 1,689,475 10/1928 Brumder ..... 273/179 C 3,561,765 2/1971 Dixon ..... 273/179 C X

*Primary Examiner*—George J. Marlo

*Attorney, Agent, or Firm*—Andrus, Sceales, Starke & Sawall

[57] ABSTRACT

A training device for ball games includes a sloping surface having a forward edge flush with the floor or ground on which the training device is placed, and upstanding walls extending upward from the edges of the sloping surface except the forward edge thereof, the sloping surface including a simulated area of such a length that it can be estimated that a ball rolling upward on the sloping surface will never pass a target when the rolling ball stops up to the inner end of the simulated area.

7 Claims, 28 Drawing Figures

FIG. 11
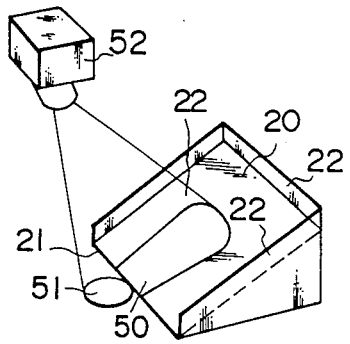
FIG. 12
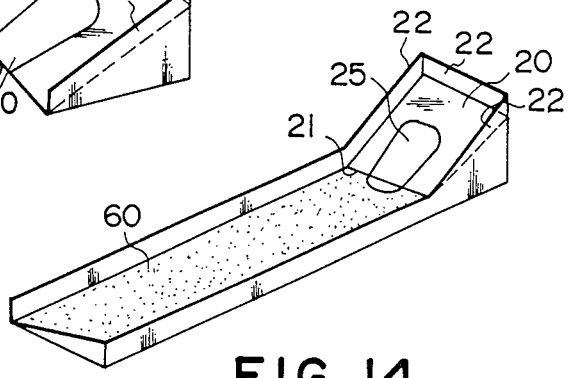
FIG. 13A
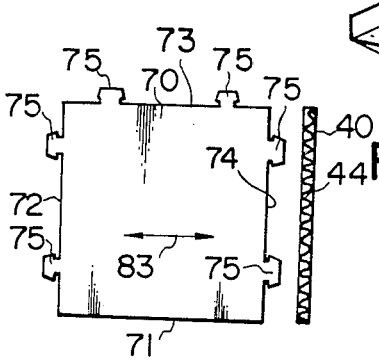
FIG. 13B
FIG. 14
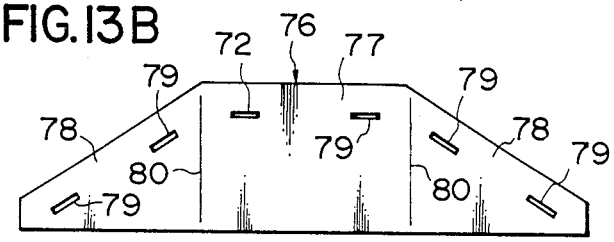
FIG. 15
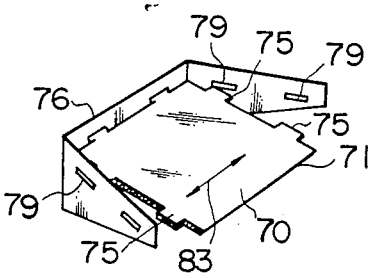
FIG. 16
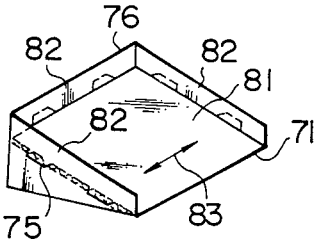

PUTTING TRAINING DEVICE FOR GOLFERS

The present invention relates to a training device for ball games such as golf, bowling and the like.

It is an object of the present invention to provide a new and novel training device which can overcome disadvantages in the prior art completely.

The present invention as well as the prior art will now be described in detail with reference to the accompany drawings in which:

FIG. 11 is a perspective view of a modified golf trainer according to the present invention;

FIG. 12 is a perspective view of a further golf trainer according to the present invention;

FIG. 13A is a plan view showing a member which is used as a sloping surface in a golf training device according to the present invention;

FIG. 13B is a cross-sectional view of the member shown in FIG. 13A;

FIG. 14 is a plan view showing another member for defining sidewalls of the training device with the sloping surface member shown in FIGS. 13A and 13B;

FIG. 15 is a perspective view of the golf trainer when it is being assembled by the use of the members shown in FIGS. 13A, 13B and 14;

FIG. 16 is a perspective view of the golf trainer shown in FIG. 15 when it is finished.

Although the following description will be made in connection with a golf training device, it is to be understood that the present invention can be applied to various training devices for the other ball games.

Figure 1:
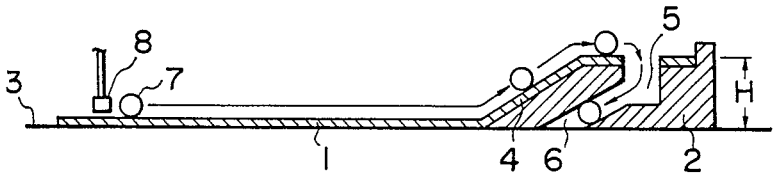
FIG. 1 PRIOR ART
FIG. 1 is a longitudinal section of a conventional golf training device.

Referring to FIG. 1, a conventional golf training device shown herein comprises a flat runway 1, which is adapted to be placed on a supporting surface such as the floor or ground 3. The raised portion 2 includes a slope 4 and a hole 5 formed in the raised portion 2 at the top thereof. The hole 5 has an inclined hole portion 6 formed therein at the bottom for accumulating balls which have entered the hole 5. When a golf ball 7 is properly hit by a golf club 8, the ball 7 rolls on the runway 1 to the raised portion 2 and then moves upwardly on the slope 4 into the hole 5.

Figure 2:
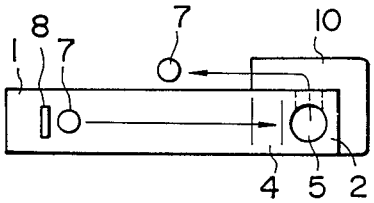
FIG. 2 PRIOR ART
FIG. 2 is a plan view of another conventional golf training device.

FIG. 2 shows another conventional golf trainer in plan in which the ball 7 moves outwardly from the hole 5 through a lateral opening formed on the side of the raised portion 2 and rolls on an outside slope 10 toward the hitting point.

In the above arrangements, the raised portion 2 is relatively high so that the hole 5 can have a sufficient depth or the ball 7 can be returned to the golfer. This is completely different from the practical green in the golf course. Moreover, the balls do not return often to the golfer, so that he must move to the balls. In the prior art golf trainers, therefore, the golfer cannot exercise any proper hitting operation.

Figure 3:
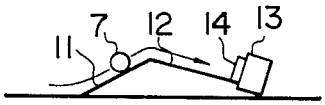
FIG. 3 PRIOR ART
FIG. 3 is a side view of still another conventional golf training device.

There is also known a golf trainer (see FIG. 3) which comprises an upward slope 11, a downward slope 12 and hitting-back means 13 located at the downward end of the downward slope 12. The hitting-back means 13 includes an actuating pad 14 which is adapted to actuate for return the ball 7 to the hitting point through the downward and upward slopes 12 and 11 when the ball 7 impacts the actuating pad 14. In addition to the need of a power source, this golf trainer does not provide any exact information about various factors of the hit ball such as motion, direction and others.

The present invention provides a golf training device which is suitable for training the manipulation of golf clubs, particularly putters which are important since a score can be improved when a putter is manipulated under delicate control.

The present invention will now be described with reference to FIGS. 4 to 27.

Figure 4:
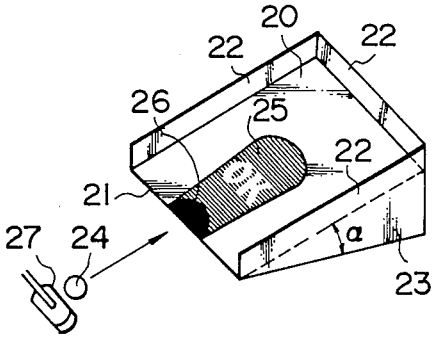
FIG. 4 is a perspective view of a golf training device according to the present invention.
Figure 5:
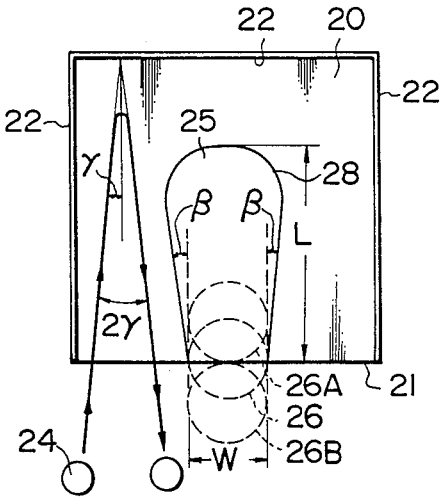
FIG. 5 is a plan view of the golf trainer shown in FIG. 4.

Referring to FIGS. 4 and 5, a golf training device according to the present invention comprises a square slope 20 having a forward edge 21 flush with the floor or ground. Three edges of the slope 20 other than the forward edge 21 have vertically upstanding walls 22 which extend upward therefrom to enclose the slope 20. Each of the upstanding walls 22 extends downwardly from slope 20 to form a sidewall 23 which supports the slope on the floor or ground at a predetermined inclination. The height of each of the upstanding walls 22 is preferably one-half the diameter of a ball 24 which is used in this golf training device.

The slope 20 includes a simulated area of inverse U-shape 25 which is printed or drawn thereon. The simulated area 25 has a semi-circle 26 printed or drawn therein at the forward edge of the slope 20, which indicates a target hole for receiving the hit ball.

When the ball 24 is hit by a putter 27, it rolls on the horizontal floor or ground to move toward the slope 20 of the golf training device according to the present invention. The ball 24 rolls upwardly on the slope 20 to a point at which the ball will have its maximum potential energy. Thereafter, the ball rolls downwardly on the slope 20 and returns to the golfer.

Supposing that an angle included between the direction in which the ball 24 enters the slope 20 upwardly and a line perpendicular to the forward edge of the slope 20 is $\gamma$, then the ball 24 moves back downwardly on the slope 20 with an angle $2\gamma$ relative to the path in which the ball 24 enters the slope 20, as shown in FIG. 5.

The center of a hole in which the ball 24 is to be received is at the center of the semi-circle 26 on the forward edge 21 of the slope 20. It is therefore assumed that the diameter of the semi-circular hole 26 corresponds to that of a practical hole. The entry width W of the simulated area 25 on the forward edge 21 of the slope 20 is equal to the diameter of the semi-circle 26. The length L of the simulated area 25 is determined such that it can be estimated that the ball 24 will never pass an imaginary hole beyond the rearward edge thereof when the ball rolls upwardly on the slope 20 toward the imaginary hole. Thus, when the ball 24 stops and moves downwardly on the slope 20 within the simulated area 25, it can be judged that the ball 24 is properly hit and enters the hole.

From experiments, it has been found that it is preferred that the inclination $\Delta$ of the slope 20 is in the range of 25 to 35 degrees and that the length L of the simulated area 25 is 330 millimeters. Each of the sides 28 of the simulated area 25 extends with an angle $\beta$ relative to a line perpendicular to the forward edge 21 of the slope 20. This angle $\beta$ is preferably in the range of 4 to 10 degrees.

The semi-circle 26 may be replaced by a circle 26A in the simulated area 25 immediately adjacent to the forward edge 21 of the slope 20 or a circle 26B outside the simulated area 25 immediately adjacent to the forward edge of the slope 20. Moreover, the simulated area 25 may be defined by the three upstanding walls 22 without indicating it on the slope 20.

Figure 6:
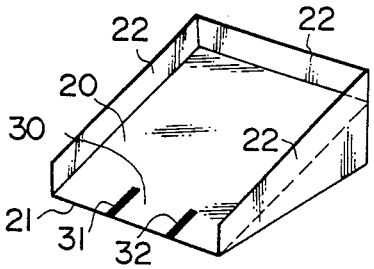
FIG. 6 is a perspective view of another golf trainer according to the present invention.

FIG. 6 shows a golf training device according to the present invention which includes a simulated area 30 defined by two parallel marks 31 and 32 spaced away from each other and which extend inwardly from the forward edge 21 of the slope 20. These marks 31 and 32 can be applied to the slope 20 by any suitable means such as printing, drawing and others.

Figure 7:
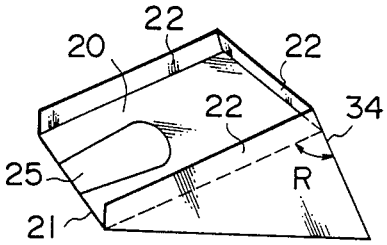
FIG. 7 is a perspective view of still another golf training device according to the present invention.

FIG. 7 shows a golf training device according to the present invention in which the back sidewall 22 and its downward extension 34 opposite to the forward edge 21 of the slope 20 are inclined downwardly and outwardly to make a right angle R between the slope 20 and the back sidewall 22, 34. Thus, if the hit ball impacts the angled upstanding wall 22, the golf trainer will not be lifted at the forward edge of the slope 20 to disturb its stable state.

Figure 8:
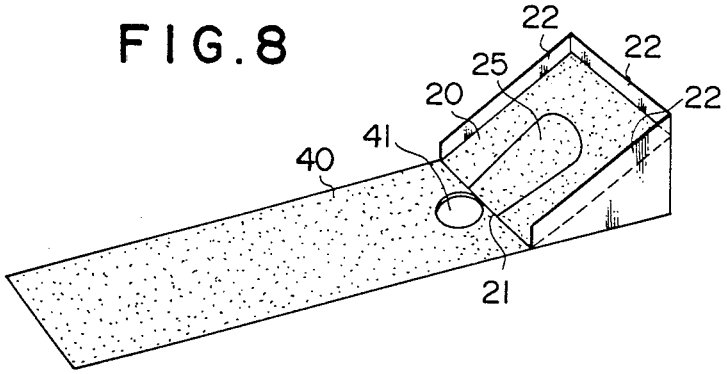
FIG. 8 is a perspective view of a further golf training device according to the present invention.

FIG. 8 shows a golf training device according to the present invention in which a horizontal runway 40 extends from the forward edge 21 of the slope 20, the runway 40 and slope 20 being covered with an artificial lawn material. The runway 40 has a circular aperture 41 formed therein immediately adjacent to the forward edge 21 of the slope 20. This circular aperture 41 is assumed to be a hole in the green of the golf course.

Figure 9:
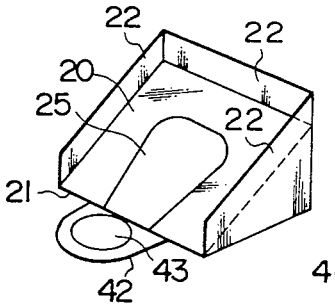
FIG. 9 is a perspective view of a further golf trainer according to the present invention.

A golf training device shown in FIG. 9 and constructed according to the present invention includes an extension 42 extending forwardly from the forward edge 21 of the slope 20 adjacent to the entry of the simulated area 25. The extension 42 includes a circular aperture 43 formed therein immediately adjacent to the entry of the simulated area 25. This aperture 43 is assumed to be a hole in the green of the golf course. The hole 43 may be drawn or printed on the extension 42.

Figure 10:
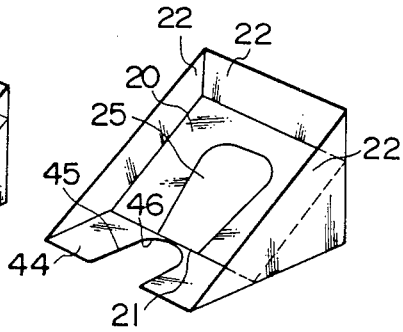
FIG. 10 is a perspective view of a further golf trainer according to the present invention.

A golf training device shown in FIG. 10 includes an extension 44 formed between the upstanding walls 22 which are also extended forwardly. The extension 44 includes a U-shaped notch 45 formed therein to extend forwardly from the forward edge 21 of the slope 20 with its semi-circular inner end being located immediately adjacent to the forward edge 21.

FIG. 11 shows a golf training device according to the present invention which includes a simulated area 50 and hole 51 projected respectively on the slope 20 and floor or ground by a projector 52 which is located above the golf trainer.

FIG. 12 shows a golf training device according to the present invention in which a runway 60 extends forwardly from the forward edge 21 of the slope 20 having the simulated area 25. The runway 60 inclines transversely relative to the length thereof. The transverse inclination of the runway 60 is provided to realize a practical green in the golf course.

A golf training device according to the present invention may be formed from two members of thick paper such as corrugated cardboard as shown in FIGS. 13 to 16. Referring to FIGS. 13A and 13B, a flat and square member 70 is made of corrugated cardboard and corresponds to a slope in the golf trainer. The member 70 has a forward edge 71 corresponding to the forward edge of the slope. Each of three side edges 72, 73 and 74 other than the forward edge 71 has a pair of tabs 75 extending outwardly from that side edge.

FIG. 14 shows a member 76 used together with the member 70 to form sidewalls of the golf trainer. The member 76 includes a central section 77 and side sections 78 extending laterally from the respective sides of the central section 77. Each of the side sections 78 is substantially of a triangle-shape. Each of the sections 77 and 78 includes a pair of slits 79 formed therein at positions corresponding to the respective pair of tabs 75 on the member 70. In assembly, the side sections 78 is folded along fold lines 80 to enclose the member 70 as shown in FIG. 15. At this time, the tabs 75 on the member 70 are inserted into the respective slits 79 on the member 76 to finally form a golf trainer as shown in FIG. 16. This golf trainer includes a slope 81 and upstanding wall 82 extending upwardly from three side edges except the forward edge 71. In FIGS. 13 to 16, a double-arrow headed line 83 denotes the direction of flutes in the corrugated cardboard used as the slope 81. This direction of flutes is preferable when the strength is considered in the golf training device.

Figure 17:
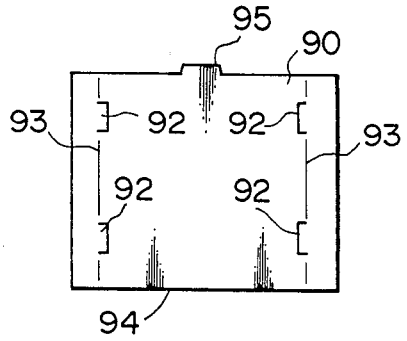
FIG. 17 is a plan view of a member used as a sloping surface in a golf trainer according to the present invention.
Figure 18:
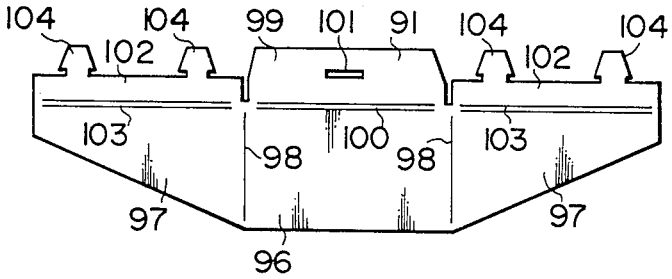
FIG. 18 is a plan view of a member used as sidewall means in the golf trainer together with the member of FIG. 17.

FIGS. 17 and 18 show cardboard members 90 and 91 used to form a golf trainer in which any tab will not extend outwardly from the outer surface of the sidewalls. The member 90 is one used to define a slope in the golf trainer and includes four cuts 92 formed on fold lines 93 which extend perpendicular to the forward edge 94 of the member 90 and parallel to each other. The opposite edge of the member 90 has a tab 95 extending outwardly therefrom.

Figure 19:
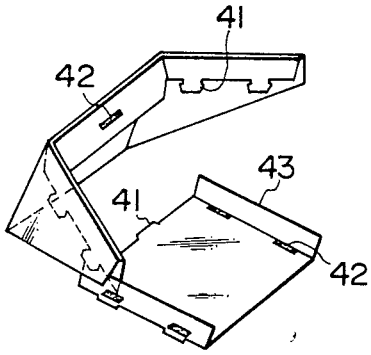
FIG. 19 is a perspective view of the golf trainer when it is being assembled by the use of the members shown in FIGS. 17 and 18.
Figure 20:
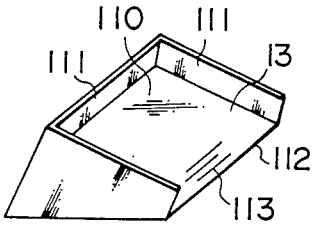
FIG. 20 is a perspective view of the golf trainer when it is finished.

The other member 91 shown in FIG. 18 includes a central section 96 and two side sections 97 connected with the central section 96 through fold lines 98. The central section 96 includes a flap 99 connected thereto at the top through a double fold line 100. The flap 99 has a slit 101 for receiving the tab 95 on the member 90 on assembling. Each of the side sections 97 includes a flap 102 connected thereto at the top through a double fold line 103. Each of the flaps 102 on the side sections 97 has a pair of tabs 104 extending upwardly from the edge thereof. These tabs 104 are inserted into the respective cuts 92 on assembling. The membes 90 and 91 are assembled to each other with the tabs inserted into the corresponding cuts or slit as shown in FIG. 19. At this time, the flaps 99 and 102 on the member 91 are folded inwardly while the member 90 is folded over along the fold lines 93. FIG. 20 shows a finished golf trainer which is similar to the embodiment of FIG. 7 and includes a slope 110 and upstanding walls 111 extending upwardly from the side edges of the slope 110 except the forward edge 112 thereof. Reference numeral 113 designates the direction of flutes in the corrugated cardboard which is used to form the slope 110.

Figure 21:
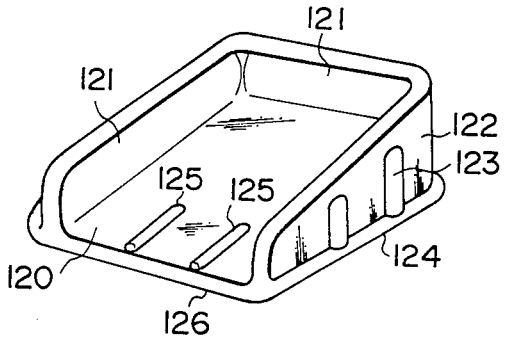
FIG. 21 is a perspective view of a molded golf trainer in accordance with the principle of the present invention.
Figure 22:
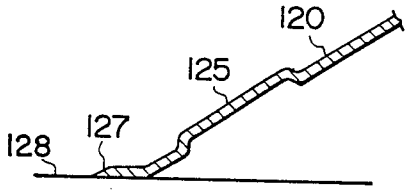
FIG. 22 is a cross-sectional view showing part of the golf trainer shown in FIG. 21.

FIG. 21 shows a golf training device according to the present invention which is vacuum formed from any plastic material. The golf training device includes a slope 120 and upstanding walls 121 extending upwardly from the side edges of the slope at the tops of the sidewalls 122 in the trainer. The sidewalls 122 are strengthened by ribs 123. The trainer also includes a surrounding flange 124 formed therein at the bottom, which flange 124 serves to stably place the golf trainer on the floor or ground. A simulated area is defined by two parallel ridges 125 spaced away from each other and extending inwardly from the forward edge 126 on the slope 120. As shown in FIG. 22, the forward edge 126 of the slope 120 is cut to form a sharp blade 127 so that a golf ball can smoothly roll onto the slope 120 from the floor or ground 128.

Figure 23:
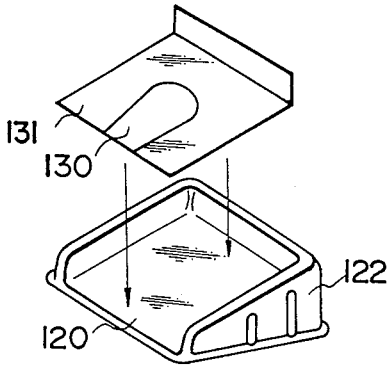
FIG. 23 is a perspective view of another molded golf trainer in which a printed sheet is to be applied to the sloping surface of the golf trainer.
Figure 24:
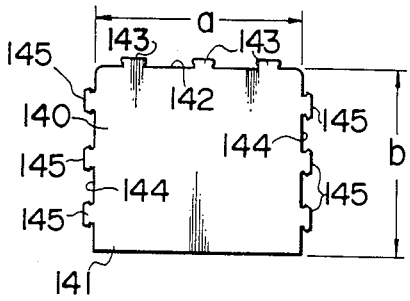
FIG. 24 is a plan view of a member for defining the sloping surface in a further golf trainer according to the present invention.
Figure 25:
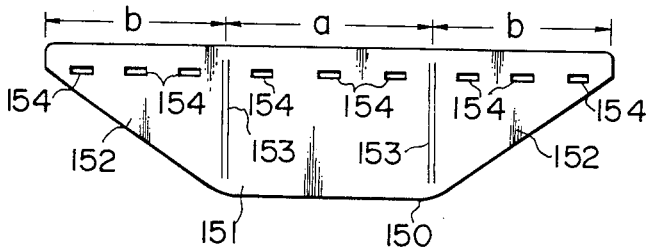
FIG. 25 is a plan view of a member for defining sidewalls of the golf trainer and which it is used together with the member shown in FIG. 24.

As shown in FIG. 23, the vacuum formed trainer may be provided with a simulated area 130 printed on a sheet 131 which is applied to the slope 120.

Figure 26:
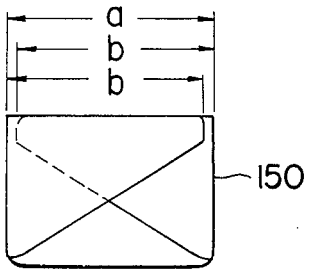
FIG. 26 is a plan view of the member shown in FIG. 25 when it is folded.
Figure 27:
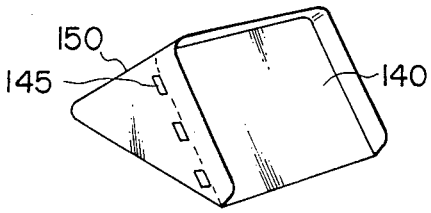
FIG. 27 is a perspective view of the golf trainer constructed of the members shown in FIGS. 24 to 26.

FIGS. 24 to 27 show a foldable golf training device of corrugated cardboard in which a member 140 used as a slope has a forward edge 141 and a rearward edge 142 including three tabs 143 formed therein. These edges 141 and 142 are of a dimension a. The member 140 also has side edges 144 each having three tabs 145 formed therein. The member 140 is assembled to a member 150 shown in FIG. 25 to form a finished golf trainer of FIG. 27. The member 150 includes a central section 151 and side sections 152 of substantially triangle-shape. The side sections 152 are connected with the central section 151 by double fold lines 153, the spacing between which is equal to the dimension a of the forward and rearward edges 141 and 142 on the member 140. On the other hand, the width of each of the side sections 152 is equal to the dimension b of the side edges 144 or the member 140. As seen from FIG. 26, the dimension a is larger than the dimension b. Therefore, the member 150 can be folded over as shown in FIG. 26. This is convenient in handling and transporting. In assembling, the tabs 143 and 145 on the member 140 are inserted into slits 154 formed in the member 150 to form a golf trainer shown in FIG. 27.

The present invention provides the following advantages:

(1) The hit ball is automatically returned to the golfer from the golf training device if the ball is properly hit. Thus, the training can more effectively be carried out.

(2) The training can be carried out on a horizontal plane.

(3) The ball is hit in the exact direction since the size and position of a target can more clearly be judged by the golfer. If the ball is wrongly hit, it is returned to the golfer at an angle two times as large as.

(4) The control of the ball can more easily be learned since the motion of the ball is enlarged at the simulated area. This advantage can further be improved by coloring the simulated area with any suitable color.

(5) In addition to the above advantages, the golf trainer according to the present invention is simple, inexpensive, light and convenient for transport, storage and other purposes.

Although the present invention has been described with reference to the preferred embodiments thereof which are illustrated in the drawings, it is to be understood that various modifications and changes can be made by those skilled in the art without departing from the scope and spirit of the invention as described in the appended claims. For example, the simulated area may be recessed on the slope. The upstanding walls may be curved relative to the direction of rolling of the ball. The slope may be variable in its angle.

I claim:

1. A training device for golf games comprising, in combination:

(a) an imperforate member providing a generally rectangular sloping surface (20) having a forward edge (21) adapted to be disposed flush with a supporting surface (3) for the device, (b) upstanding golf ball-confining wall means (22) extending upwardly from said sloping surface (20), (c) first visually-observable indicia disposed on said sloping surface (20) and forming an inverted generally U-shaped discrete ball-rolling zone (25) extending rearwardly from said forward edge (21), (d) said generally U-shaped zone having side portions spaced inwardly from adjacent said ball confining wall means (22) and disposed angularly thereto and converging to spaced terminus portions at said forward edge (21), (e) and second visually observable indicia (26) positioned on said U-shaped zone adjacent said forward edge (21) and extending between and of the same width as the distance between said spaced terminus portions of said generally U-shaped zone (25), (f) said second indicia (26) defining at least a portion of a simulated target hole for a golf ball (24).

2. The training device of claim 1 in which said second indicia (26) is shaped as a semi-circle having its center disposed on said forward edge (21) of said imperforate member.

3. The training device of claim 1 or 2 in which:

(a) the inclination of said sloping surface (20) of said imperforate member is in the range of 25° to 35° when said training device is mounted on said supporting surface (3), (b) the length (L) of said ball-rolling zone (25) is 330 millimeters, (c) and said side portions of said U-shaped zone (25) are disposed at an angle of 4° to 10° from said adjacent wall means (22).

4. The training device as defined in claim 1, further including a runway on which the ball rolls, said runway being defined by a flat sheet which extends forwardly from the forward edge of said sloping surface.

5. The training device as defined in claim 4 wherein said runway is inclined transversely relative to the length thereof.

6. The training device as defined in claim 1, wherein said first indicia is printed on a sheet which is applied to said sloping surface.

7. The training device as defined in claim 1, wherein said first indicia is an image projected on said sloping surface.

* * * * *